US008171931B2

(12) United States Patent
Frimann

(10) Patent No.: US 8,171,931 B2
(45) Date of Patent: May 8, 2012

(54) VALVE UNIT FOR A REBREATHER APPARATUS

(75) Inventor: Lars Erik Frimann, Jar (NO)

(73) Assignee: Radikal AS, Alesund (NO)

( * ) Notice: Subject to any disclaimer, the term of this patent is extended or adjusted under 35 U.S.C. 154(b) by 806 days.

(21) Appl. No.: 12/226,766

(22) PCT Filed: Apr. 28, 2006

(86) PCT No.: PCT/NO2006/000161

§ 371 (c)(1),
(2), (4) Date: Dec. 22, 2008

(87) PCT Pub. No.: WO2007/126317

PCT Pub. Date: Nov. 8, 2007

(65) Prior Publication Data

US 2009/0101143 A1 Apr. 23, 2009

(51) Int. Cl.
*A63B 21/00* (2006.01)

(52) U.S. Cl. ..... 128/205.24; 128/200.26; 128/206.19; 128/857

(58) Field of Classification Search ..... 128/205.24, 128/127, 251, 200.26, 857, 206.21, 206.19, 128/200.24
See application file for complete search history.

(56) References Cited

U.S. PATENT DOCUMENTS

| | | | |
|---|---|---|---|
| 5,127,398 | A | 7/1992 | Stone |
| 5,746,199 | A | 5/1998 | Bayron et al. |
| 6,513,525 | B2 | 2/2003 | Chen |
| 6,681,766 | B1 | 1/2004 | Matsuoka |
| 2002/0157669 | A1 | 10/2002 | Chen |

OTHER PUBLICATIONS

International Search Report mailed Dec. 5, 2006 for International Application No. PCT/NO06/000161.
Written Opinion of the International Searching Authority mailed Dec. 5, 2006 for International Application No. PCT/NO06/000161.

*Primary Examiner* — Jerome W Donnelly
(74) *Attorney, Agent, or Firm* — Wenderoth, Lind & Ponack, L.L.P.

(57) ABSTRACT

The present invention concerns a valve unit for a rebreather apparatus that recycles gas exhaled by a user. The valve unit includes a housing 5 with a first port for communication with a respiratory system of the user and a first inlet port 9 for breathable gas in said housing, a first exit port for exhausting gas from said housing into a flow channel, at least one separate second exit port 12 for exhausting gas form said housing 5 into an ambient environment, a second inlet port 13 for breathable gas connected to an open loop inlet valve 6 in said housing 5, and a valve body 4 in said housing 5 forming a valve for switching between two operating modes. The valve body 4 is formed as a barrel or cylinder with valve openings sealing against the housing 5, where the valve body 4 forms an internal cavity 18, alone or in combination with the housing 5, in connection with the port 10 for communication with a user. The valve 6 has an outlet in said cavity 18.

12 Claims, 4 Drawing Sheets

20

VALVE UNIT FOR A REBREATHER APPARATUS

The present invention concerns a valve unit for a rebreather apparatus, in particular a mouthpiece. A rebreather is a type of breathing apparatus that recycles gas exhaled by a user, for instance a diver.

In the past rebreathing apparatuses has been increasingly used, in particular for underwater diving.

Two categories of designs are typically being used, and traditionally an open circuit or open loop system has been used where a gas exhaled by a user is expelled to the surroundings. Such systems are however bulky and inefficient in that the oxygen not absorbed during each breath is expelled and wasted.

Closed circuit rebreathing systems makes use of all the oxygen content of the supply by removing the carbon dioxide generated by the user and by replenishing oxygen or oxygen containing gas as needed. The rebreather systems generally includes a mouthpiece placed in a users mouth or in connection with a face mask and is connected to the breathing apparatus by two flexible hoses, one to supply breathable gas, and one to remove the exhaled gas and lead this back to the apparatus. The system then extracts the $CO_2$ from the expelled gas, and replenishes oxygen.

The rebreather system must remove any exhaled carbon dioxide. Carbon dioxide is removed by a carbon dioxide absorbent material which typically is a calcium hydroxide and sodium hydroxide mix. Effective carbon dioxide removal is critical when using a rebreather, as excess carbon dioxide known as hypercapnia has serious and possibly fatal results for a user whilst in a hazardous environment such as underwater. Carbon dioxide is an odourless, tasteless gas that is very difficult to detect electronically. Hypercapnia does however have some signs and symptoms such as nausea, headache- and shortness of breath. The onset of hypercapnia can have serious debilitating effects on the user, causing difficulty in decision making, and this may have fatal consequences.

Accordingly it has been developed systems that enable a user to switch from the rebreather loop to a breathable open circuit gas thus removing the source of carbon dioxide build up. Such a breathing apparatus can for instance be found in U.S. Pat. No. 5,127,398 showing a breathing apparatus mouthpiece, which describes a combined rebreather and open circuit system.

The system shown in U.S. Pat. No. 5,127,398 shows a unit with an exit port for exhausting gas from a housing into an ambient environment, placed on top of the unit, and a valve for selectively opening and closing an entrance port in a separate chamber for admitting breathable gas to a user. A diaphragm is placed in this additional cavity for sensing the pressure and thus supplying breathable gas to the user through this separate cavity and a duct system.

According to the present invention, it is provided a compact, easy to use system that is cost effective to manufacture, and that provides considerable safety for a user. The system according to the invention enables a user to easily flush the unit for unwanted fluids or objects, and the unit expels used gas at the bottom of the part to lead bubbles away from the user when it is used for diving purposes.

Furthermore the unit is more compact than previous designs, is easier to service, easier to manufacture, and easier to clean.

This is achieved with an apparatus according to the present invention.

Accordingly, the present invention concerns a valve for a rebreather apparatus that recycles gas exhaled by a user. The valve is normally a mouthpiece and includes a housing that may be made of a suitable metal or synthetic material commonly used for mouthpieces. The housing may be one integral part or be assembled of several units. The housing includes a port for communication with a user, normally through the mouth of the user that communicates with the respiratory system of the user. Normally the port is connected to a part for insertion into the user's mouth, but the valve may also be used for respiratory systems that for instance include a face mask or helmet. The housing has a first inlet port for leading breathable gas into the housing. A one way inlet valve is normally placed at the inlet. A first exit port in the housing allows exhausted gas from the user to exit into a flow channel. A one way outlet valve is normally placed in connection with the first exit port. The one way valves may be of any kind, well known within the field.

The housing furthermore includes at least one at least separate second exit port for exhausting gas form said housing into an ambient environment. The housing is normally sealed from the ambient environment by a second one way exit valve. A second inlet port for breathable gas is connected to a pressure actuated valve in the housing. This valve may typically be an ordinary valve known from open loop breathing systems and may me connected to a separate pressureized supply of breathable gas. A separate valve body is placed in the housing. The valve body is sealing against an internal face, typically a cylindrical boring, in the housing. Sealing elements such as O-rings or other suitable elements may be placed between the housing and the valve body to ensure a proper seal against openings in the valve body and the internal faces or walls of the housing. The valve body forms together with the housing a valve for switching between two operating modes. The valve body is formed as a barrel or cylinder with valve openings sealing against the housing as previously mentioned. The valve body is hollow and forms an internal cavity alone or in combination with the housing. The open loop breathing valve is at least partly located inside this cavity. In many cases, the open loop valve is placed completely inside the cavity, with only the inlet extending through the housing. The internal cavity is in connection with the port for communication with the user. The pressure actuated valve has an outlet is in the cavity. The outer boundaries of the cavity may be defined by the inner face of the valve body, a diaphragm and the inner walls of the housing part extending further than the inner face or walls of the valve body. The open loop breathing valve may be placed inside the cavity, above the valve body, and may be connected to a supply for breathable gas for instance from the side or from above, even though fitting from above may be less practical as the supply hose could extend into the field of view of the user unless it is used a bend.

The cavity inside the unit may normally be substantially a cylindrical cavity with sealed ends, at one end by the diaphragm and at the other, the perforated end wall. The housing is normally without any inner channels or ducts except from the inlets and outlets of the cavity. The valve body may extend through the entire housing, or only part way up the cylindrical bore of the housing, but must of course extend past the inlet and outlet ports for the rebreather in order to be able to block the ports in the open loop mode. The inner cavity is preferably a unitary cavity without additional "rooms", ducts or connected rooms etc. that all the ports are connected to, and that the open loop inlet valve is placed inside. The cavity is normally only the substantially cylindrical bore inside the housing, where all the ports are connected, and where the cylindrical valve body is placed.

The valve body includes a central longitudinal rotational axis and that the valve may be placed in the longitudinal axis of the valve body such that the valve body can rotate in the housing around the open loop pressure actuated valve. The pressure actuated valve may be secured to the housing or an end wall of the valve body. If the pressure actuated valve is secured to the valve body, one dynamic seal is omitted but it must be ensured that rotation of an inlet hose connected to the pressure actuated valve does not inadvertently shifts the valve body in the housing.

The cylindrical valve body includes an upper end and a lower end, and the at least one exit port for exhausting gas from the housing into the ambient environment exits at the lower part of the valve body. In this connection, "up", "down", "upper" and "lower" refers to locations on the apparatus in use when a user is standing upright in a normal standing position.

A diaphragm may be placed at the top of the valve body and may communicate mechanically with the pressure actuated valve as a response to the pressure in the valve housing. Alternatively, other pressure sensing means may be used to actuate the pressure actuated valve.

The valve housing may be rotationally placed in the housing, such that the valve housing can be shifted between a first and a second position to select between a first and a second mode of operation. In the first position, the first inlet port and the first exit port communicates with the cavity inside the valve body and in a second position for the second mode of operation, the valve body seals the housing from the first inlet port and the first exit port.

The valve body may include a leaver extending through the housing for operation by a user for manually shifting between the two modes of operation.

Alternatively the valve body may be actuated by an actuator for automatically changing between the two modes of operation. Any suitable actuator may be used, and the actuator may be controlled by a censor censing the quality of the gas.

The diaphragm at the upper end of the apparatus can be manually operated to operate the pressure actuated valve to flush the apparatus.

A one way valve may be placed at the second exit port at the bottom of the housing, and the one way valve may be annular and surround the pressure actuated inlet valve.

The valve body may include an end portion with perforations, and the housing may include a lower portion with perforations corresponding to the perforations in the valve housing, such that the perforations in the valve housing are aligned with the perforations in the housing when the valve body is in the second mode of operation, and the perforations are misaligned when the valve housing is in the first mode of operation to seal the housing from the second exit ports.

The diaphragm may be secured to the valve housing to seal against this housing.

A rebreathing apparatus with the unit according to the invention can be used by underwater divers, smoke divers, miners, mountain climbers and by others that needs a portable life support system that can be used in situations where an ambient environment not can be bred due to lack of oxygen in useful form or due to the presence of toxic fumes.

BRIEF DESCRIPTION OF THE ENCLOSED DRAWINGS

DETAILED DESCRIPTION OF AN EMBODIMENT OF THE INVENTION WITH REFERENCE TO THE ENCLOSED DRAWINGS

Figure 1:
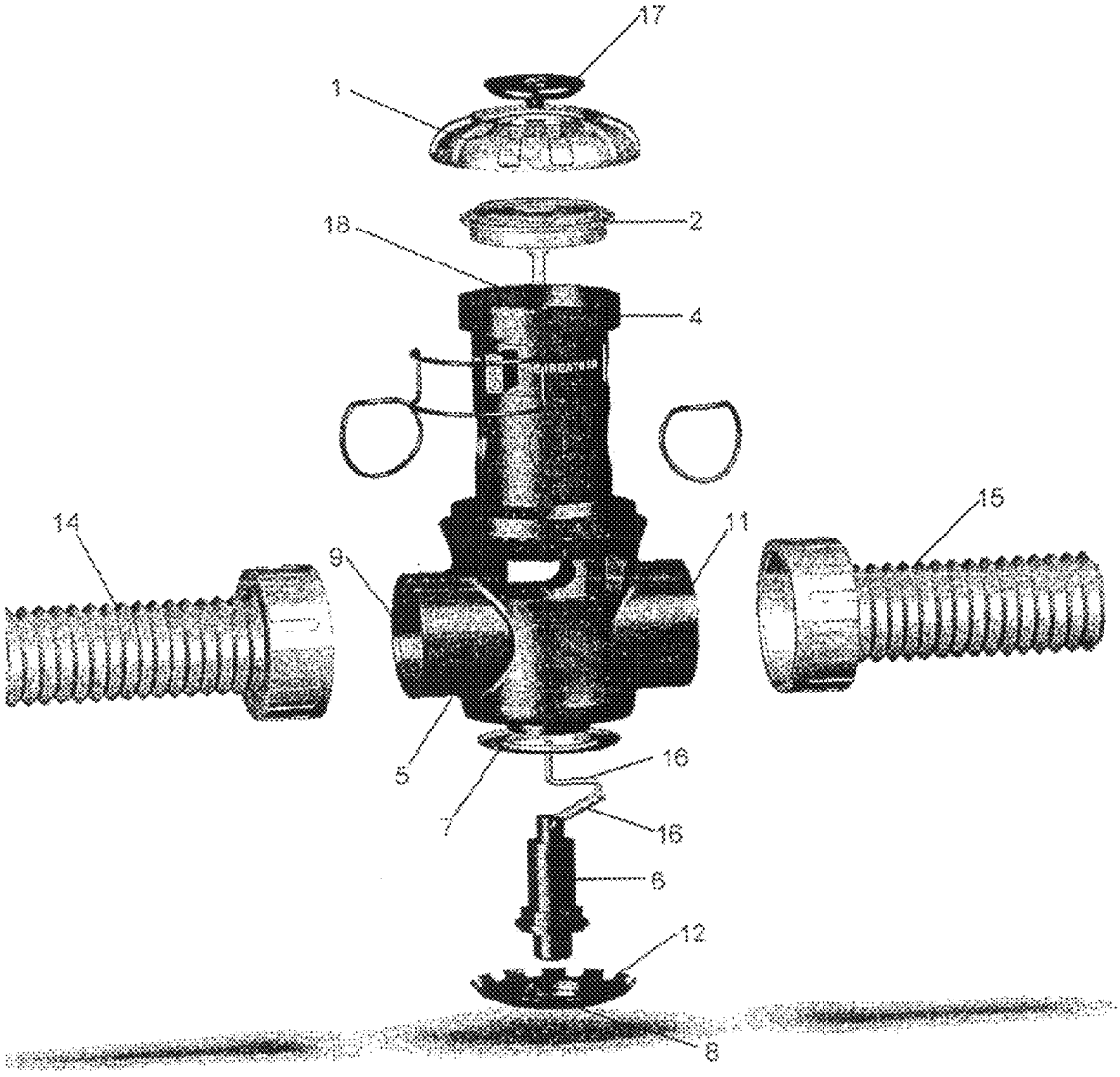
FIG. 1 shows an exploded view of an embodiment of an apparatus according to the invention.

FIG. 1 shows an exploded view of an embodiment of the invention, where an outer barrel or housing 5 is shown. The housing 5 includes connections for connecting an inlet hose 14 and an outlet hose 15. Furthermore the housing 5 includes, a first inlet port 9 for breathable gas and first exit port 11 for exhausting gas into the outlet hose or flow channel 15. A valve 6 such as a second stage breathing valve is installed into the bottom of the housing 5. A membrane 7 serving as a one-way valve is placed around the valve 6, and serves to expel exhaled gas from the user into the environment through ports 12 in a bottom unit 8. An inner barrel or valve body 4 fits sealingly inside the outer barrel or housing 5 and is placed substantially with a vertical axis, and can be angularly rotated inside the housing 5 to shift the valve between two positions and accordingly between two modes of operation. The bottom of the valve body 4 includes a lower wall part with a central opening for the open loop inlet breathing valve 6. Furthermore the bottom of the valve body includes perforations (not shown on FIG. 1) corresponding to perforations in the housing 5 (not shown) such that the perforations are misaligned and closed for communication with the ambient environment in a first position, and aligned such that exhaled gas from the user can escape through the perforations and through the valve membrane 7 in a second position.

The barrel shaped or cylindrical valve body 4 includes an inner cavity, at least one inlet opening, at least one outlet opening and a slot or a series of perforations in the cylindrical part of the body. The inlet opening is adapted to be aligned with the inlet port of the housing 5 and the outlet opening is adapted to be aligned with the outlet port of the housing 5 when the apparatus is in the first rebreather mode of operation. In the second open loop mode, the inlet and outlet openings or ports are misaligned and accordingly sealed. The slot or series of perforations ensures that the inner cavity always communicates with the outlet for the user. In an alternative embodiment, the cavity in the body communicates with the port for the user through the open top of the valve body 4. The wall at the bottom of the valve body 4 includes the mentioned perforations and the central opening for the open loop inlet breathing valve 6, such that the major part of this valve 6 can be placed inside the cavity of the valve body 4.

In the first mode of operation with the valve body in a first position, the perforations at the bottom of the apparatus are closed, and breathable gas is inhaled through the inlet hose 14, through the inlet 1, into the users mouth, and is exhaled through the exhaust port 11 into the outlet hose or flow channel 15.

A diaphragm 2 is sealingly placed at the top of the valve body 4 or housing 5, and is connected to the valve 6 through a valve actuating mechanism 16. O-rings seals between openings in the valve body 4 and the housing 5. A breather purge button 17 can be used to manually open the valve 6 to flush any unwanted fluids or objects from the cavity 18 inside the valve body 4 and the housing 5 and out of the perforations at the bottom of the valve body 4, the housing 5, the one way membrane valve 7 and finally through the ports 12. The valve 6 includes an inlet 13.

Figure 2:
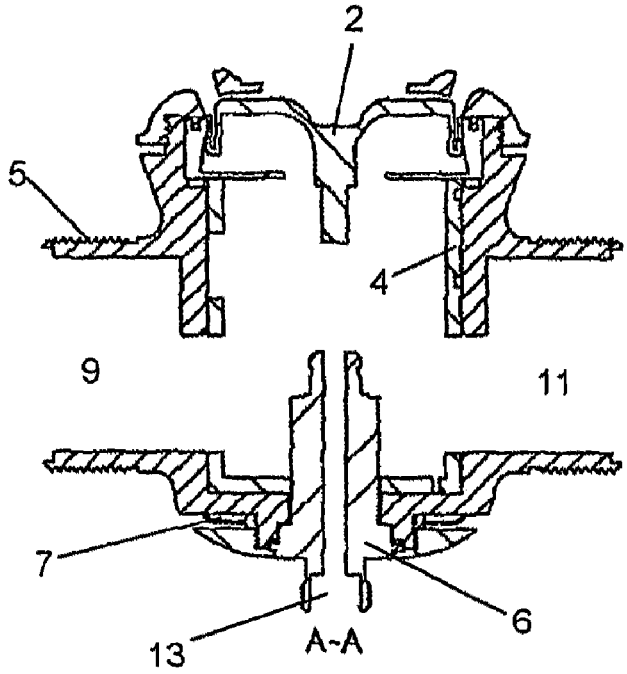
FIG. 2 is a cross-section of the apparatus shown on FIG. 1 in a first mode of operation.

FIG. 2 is a cross-section of the unit shown on FIG. 1, showing the unit in the first mode of operation for rebreathing, where inlet gas to the user can flow through the inlet 9 and can be exhaled through the outlet 11. The housing 5 is shown with threads for connection with the inlet hose 14 and the outlet hose 15. The secondary valve 6 is also shown in addition to the diaphragm 2 and the valve body 4.

Figure 3:
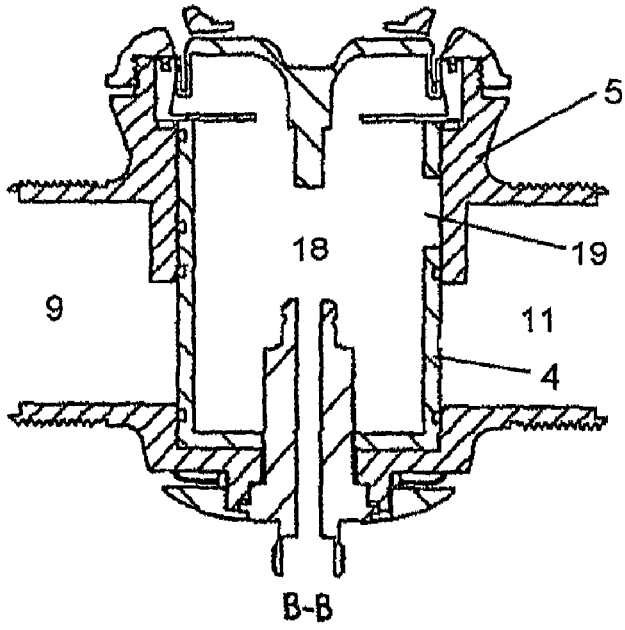
FIG. 3 is the cross-section shown in FIG. 2 in a second mode of operation.

FIG. 3 shows the apparatus in the second mode or configuration, where the valve body 4 blocks the inlet 9 and the outlet 11 in that the openings in the valve body 4 now not are aligned with the openings 9 and 11 of the housing 5, but the perforations at the bottom of the valve body 4 are aligned with the perforations in the housing 5 such that exhaled air can escape through the outlet valve 7 and the ports 12 shown on FIG. 1. FIG. 3 also shows grooves for suitable seals such as O-rings to ensure a proper seal between the inner barrel or valve body 4 and the outer barrel or housing 5.

A slot 19 in the inner barrel or valve body 4 ensures that the inner cavity 18 of the valve body 4 always is in communication with the port for communication with the respiratory system of the user, such as communication with the mouth.

The diaphragm may in one embodiment be placed in the valve-body and may rotate with the valve body when this is shifted between the operation modes, making it easier to seal the transition between the diaphragm 2 and the valve body 4.

Figure 4:
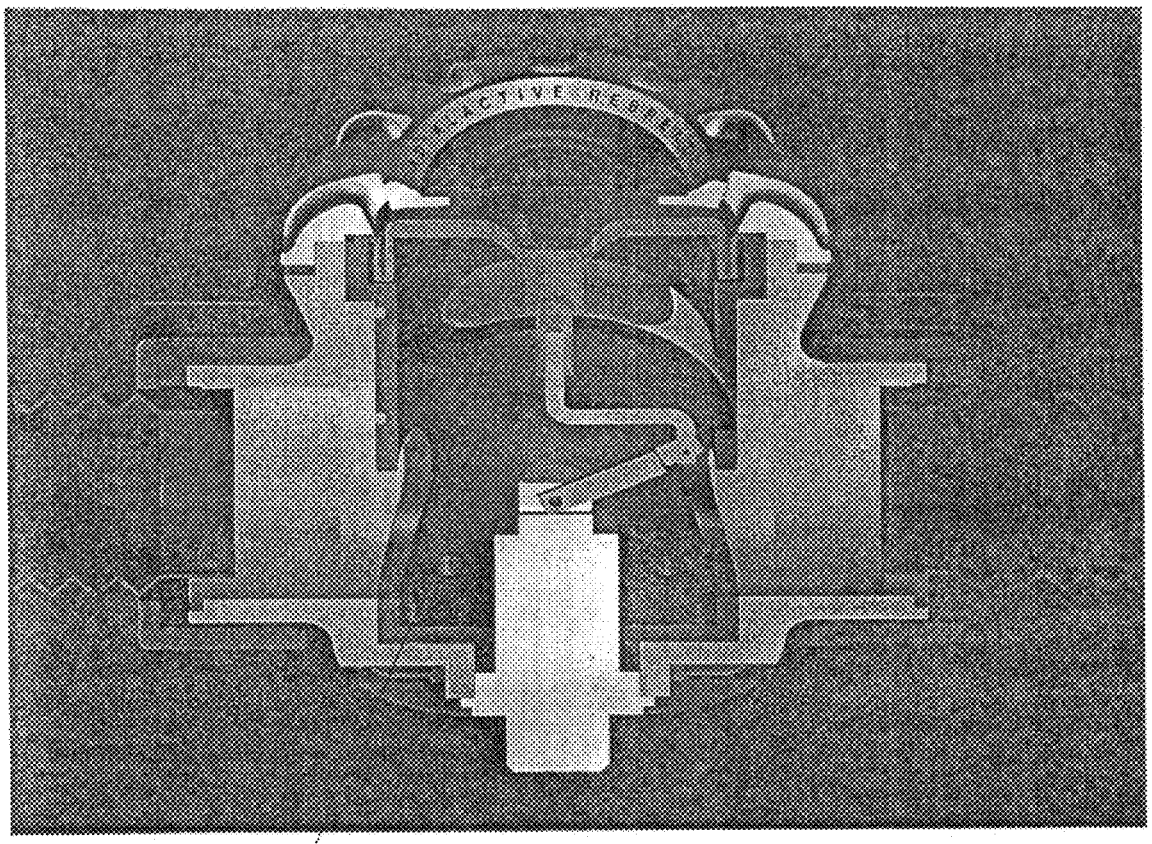
FIG. 4 is a cross-section in perspective view of the apparatus as shown on FIGS. 1, 2 and 3.

FIG. 4 is a cross-section in perspective view of the apparatus as shown on FIGS. 1, 2 and 3, where the perforations 20 in the bottom end wall of the valve body are clearly shown. The open circuit inlet valve is shown schematically without any interior details. The slot in the valve body for the port for communication with the user is also shown.

Figure 5:
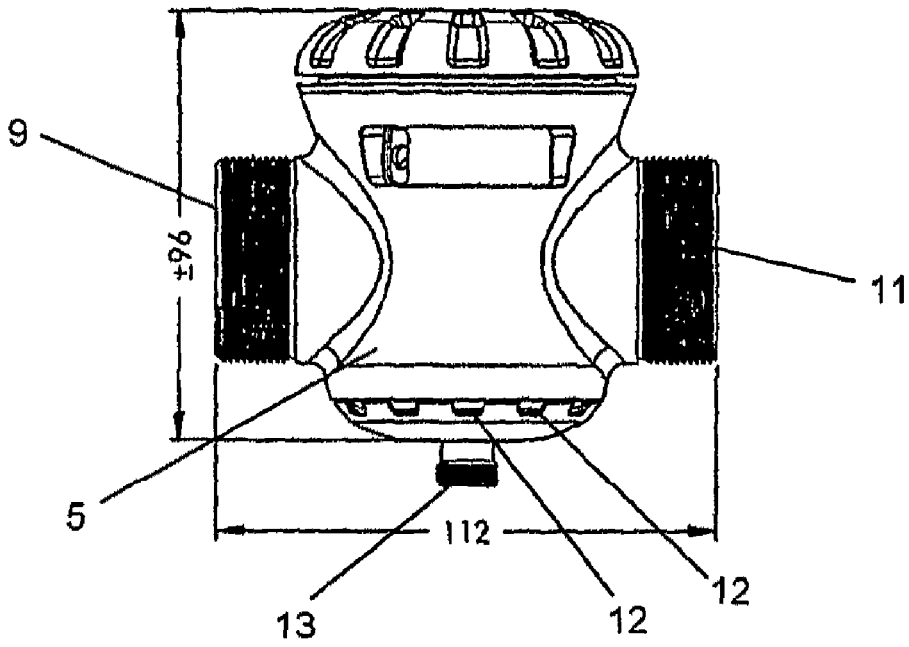
FIG. 5 is a side elevation of the embodiment of the invention shown in FIGS. 1, 2, 3 and 4.

FIG. 5 is a side elevation of the apparatus shown on the previous figures where the inlet port 9, the outlet port 11, the inlet port 13, the outlet port 12 and the housing 5 is clearly shown. Furthermore, the connections for the inlet and outlet hoses can be seen.

Figure 6:
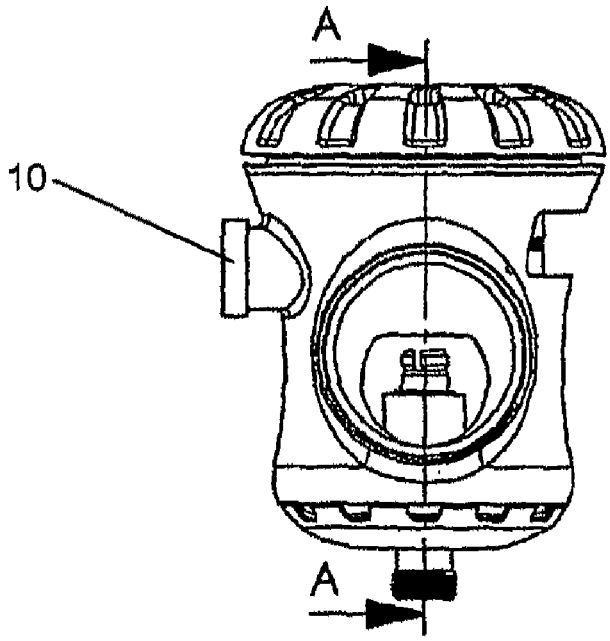
FIG. 6 is a side elevation of the embodiment shown on FIG. 5.

FIG. 6 is a side elevation of the embodiment shown on FIG. 5, but where the port 10 for communication with a user is clearly shown. FIG. 6 shows the apparatus in the first mode of operations where the ports in the valve body are aligned with the inlet and outlet ports of the housing. From the figure, it is also shown how the secondary valve with an inlet port 13 is centrally placed along an axis of rotation of the valve body 4 such that the valve with inlet 13 can be placed through the valve body 4 into the cavity 18.

The inner barrel or valve body 4 is shown connected to a leaver, and in the shown embodiment the barrel 4 can be can be moved 65° in both directions, allowing the lever to shift between the modes of operation by opening and closing the various ports with one single motion.

When the open loop system is used, the valve body blocks the holes of the rebreather and opens the holes for expelling exhaled gas at the bottom of the barrel and the mouthpiece or apparatus. When the rebreathing system is used, the valve body opens the holes of the apparatus and closes the exhaling hose of the open system. The second stage supply valve built into the apparatus has an opening into the cavity and can either be connected to a gas tank built into the rebreather, or that is provided as a separate unit. Because the second stage supply valve is placed inside the mouthpiece of the rebreather or apparatus, weight and size is reduced. This also results in a better view and less bulk for the user.

The open integrated supply valve is connected to the diaphragm and to an actuator arm. When the user shifts to the open system, the user will create a reduced pressure inside the mouthpiece during breathing. This reduced pressure actuates the diaphragm that actuates the actuator arm that is connected to the valve. The valve then supplies gas to the user.

If the mouthpiece needs to be flushed for instance for water, it is only necessary to move the valve body to the open mode. When air is blown into the mouthpiece, this will create an increased pressure pressing for instance the water through the outlet valve at the bottom of the mouthpiece. It is also possible to expel the water by pressing the purge button at the top of the mouthpiece. The button actuates the diaphragm activating the actuator arm that actuates the valve, increasing the pressure in the mouthpiece such that the water is expelled through the outlet valve.

The invention claimed is:

1. A valve unit for a rebreather apparatus that recycles gas exhaled by a user, comprising:

a housing (5) with a first port for communication with a respiratory system of the user;

a first inlet port (9) for breathable gas in said housing;

a first exit port for exhausting gas from said housing into a flow channel;

at least one separate second exit port (12) for exhausting gas form said housing (5) into an ambient environment;

a second inlet port (13) for breathable gas connected to an open loop inlet valve (6) in said housing (5);

and a valve body (4) in said housing (5) forming a valve for switching between two operating modes, and where the valve body (4) is formed as a barrel or cylinder with valve openings sealing against the housing (5), where the valve body (4) forms an internal cavity (18), alone or in combination with the housing (5), in connection with the port (10) for communication with a user, characterized in that said valve (6) has an outlet in said cavity (18).

2. The valve unit of claim 1, characterized in that the open loop inlet valve (6) is placed inside the cavity (18) formed by the valve body (4) and the housing (5).

3. The valve unit of claim 1, characterized in that the valve body (4) includes a central longitudinal rotational axis and that the valve (6) is placed in the longitudinal axis of the valve body (4).

4. The valve unit according to claim 1, characterized in that the cylindrical valve body (4) includes an upper end and a lower end, and that the at least one exit port for exhausting gas from the housing into the ambient environment exits at the lower part of the valve.

5. The valve unit according to claim 1, characterized in that a diaphragm (2) is placed at the top of the valve body (4) and that the diaphragm (2) communicates with the valve (6) to actuate valve (6) as a response to the pressure in the valve housing (4).

6. The valve unit according to claim 1, wherein the valve housing (4) is rotationally placed in the housing (5), such that the valve housing (4) can be shifted between a first and a second position to select between a first and a second mode of operation, wherein the first position, the first inlet port (9) and the first exit port (11) communicates with the cavity inside the valve body; and the second position for the second mode of operation, the valve body seals the housing from the inlet port (9) and the exit port (11).

7. The valve unit according to claim 1, wherein the valve body (4) includes a leaver extending through the housing (5) for operation by a user for manually shifting between the two modes of operation.

8. The valve unit according to claim 7, characterized in that the valve body (4) is actuated by an actuator for automatically changing between the two modes of operation.

9. The valve unit according to claim 1, characterized in that a diaphragm (2) can be manually operated to operate the valve (6).

10. The valve unit according to claim 1, characterized in that a one way valve (7) is placed at the second exit port at the bottom of the housing (5), and that the one way valve (7) is annular and surrounds the inlet valve (6).

11. The valve unit of claim 1, characterized in that the valve body (4) includes an end portion with perforations, and that the housing (5), includes a lower portion with perforations corresponding to the perforations in the valve housing (4), such that the perforations in the valve housing are aligned with the perforations in the housing (5) when the valve body (4) is in the second mode of operation, and the perforations are misaligned when the valve housing (4) is in the first mode of operation to seal the housing from the second exit ports.

12. The valve unit of claim 1, wherein the diaphragm (2) is sealingly secured to the valve housing (4).

* * * * *